US005191724A

United States Patent [19]

Fontanille

[11] Patent Number: 5,191,724

[45] Date of Patent: Mar. 9, 1993

[54] METHOD AND A SYSTEM FOR GRINDING AND DRYING A SOLID FUEL

[75] Inventor: Daniel Fontanille, Rambouillet, France

[73] Assignee: Stein Industrie, Velizy-Villacoublay, France

[21] Appl. No.: 775,951

[22] PCT Filed: Mar. 6, 1991

[86] PCT No.: PCT/FR91/00180

§ 371 Date: Oct. 29, 1991

§ 102(e) Date: Oct. 29, 1991

[87] PCT Pub. No.: WO91/14133

PCT Pub. Date: Sep. 19, 1991

[30] Foreign Application Priority Data

Mar. 6, 1990 [FR] France ..... 90 02804

[51] Int. Cl.[5] ..... F23K 1/00

[52] U.S. Cl. ..... 34/12; 34/30; 34/60; 34/54; 34/29

[58] Field of Search ..... 34/12, 60, 29, 30, 31, 34/26, 50, 61, 34, 35, 54

[56] References Cited

U.S. PATENT DOCUMENTS

| | | | |
|---|---|---|---|
| 3,894,344 | 7/1975 | Malcolm | 34/12 |
| 4,502,227 | 3/1985 | Janusch | 34/12 |
| 4,592,293 | 6/1986 | Toyama et al. | 110/347 |

FOREIGN PATENT DOCUMENTS

| | | |
|---|---|---|
| 1138994 | 10/1962 | Fed. Rep. of Germany . |
| 3441475 | 11/1984 | Fed. Rep. of Germany . |
| 1118768 | 11/1954 | France . |
| 1377669 | 11/1963 | France . |
| 0234017 | 12/1986 | France . |
| 1124327 | 12/1965 | United Kingdom . |

OTHER PUBLICATIONS

"Un Broyeur Unique Par Chaudiere en Chauffe Directe" by G. Vergniol (Jun. 1985) 2048 Revue Alstholm, No. 1 pp. 31–40.

"Rohrkugelmuhlen fur eine Steinkohlenstaubfeuerung mit direkter Einblasung" by Von W. Heitmuller, K. Straub and F. Thelen, VGB Kraftwerkstechnick 67 (May 1987) No. 12, pp. 1185–1192.

*Primary Examiner*—Henry A. Bennet
*Assistant Examiner*—Denise L. F. Gromada
*Attorney, Agent, or Firm*—Sughrue, Mion, Zinn, Macpeak & Seas

[57] ABSTRACT

An adjustable temperature gas feed is available that feeds firstly the grinder and secondly pre-drying means. At the outlet from the grinder, the gas that has passed through the grinder is combined with the gas that has passed through the pre-drying means to convey the ground material. The total gas flow rate $Q_A$ at the oulet lies between a minimum flow rate and a maximum flow rate, and the flow rate $Q_1$ of the gas passing through the grinder (1) is proportional to the quantity $Q_c$ of material placed in the grinder. According to the invention, a temperature T to be reached by the gas outlet temperature is set (optionally as a function of the moisture content of the material), and the gas feed is adjusted in such a manner that the feed gas is as hot as possible with the quantity of gas passing through the pre-drying means being limited to as little as possible. The method adapts to the material having different moisture contents and improves efficiency while leading to combustion with low $NO_x$.

2 Claims, 2 Drawing Sheets

METHOD AND A SYSTEM FOR GRINDING AND DRYING A SOLID FUEL

The present invention relates to a method of adjusting the operation of apparatus for grinding a solid fuel material having a variable moisture content, and for drying said material, said apparatus being fed with material via pre-drying means in which there is a gas feed whose temperature can be adjusted over a range, the feed gas being split into two fractions, one fraction of the gas passing through the grinding apparatus and the other fraction of the gas being sent to the pre-drying means, the flow rate $Q_1$ of the fraction of the gas passing through the apparatus being adjusted to be proportional to the flow rate $Q_c$ of material to be ground, the fraction of gas passing through the pre-drying means rejoining the fraction of gas leaving the apparatus together with the ground material, and all of the gas and ground material being sent via conveyor pipework, the temperature T of the gas and the ground material in said conveyor pipework being measured, the temperature of the feed gas being adjusted as a function of the difference between a set temperature $T_1$ and the measured temperature T in such a manner as to cause the measured temperature T to move closer to $T_1$, the flow rate $Q_2$ of the gas fraction feeding the pre-drying means being adjusted in such a manner that the total gas flow rate $Q_A$ in the conveyor pipework lines between a minimum flow rate $Q_{Am}$ and a maximum flow rate $Q_{AM}$.

Such a method is described in an article by Vergniol published in the French journal "Revue Alsthom" No. 1, 1985, pp. 31 to 40, and entitled (in translation) "A single grinder per direct heating boiler".

In the prior method, adjustment is provided for a fuel material having the highest degree of moisture that can normally be used in the boiler under consideration.

The flow rate through the outlet pipework must be not less than a minimum flow rate since below that rate the ground material is no longer transported properly. Also, this flow rate cannot exceed a maximum flow rate since above that rate the ducting is damaged by erosion.

As a result, for an entire range of fuel material having lower moisture content than the material for which the boiler is adjusted, in order to obtain the desired outlet temperature it is necessary to add much too much gas in the pre-drying means and also to reduce the temperature of the feed gas, thereby giving rise to poor efficiency.

In addition, when increasing the quantity of ground material to the maximum possible, the inventor has observed that it is advantageous for the flow rate $Q_2$ of the pre-drying gas fraction to be adjusted as low as possible so that the total gas flow rate $Q_A$ through the conveying pipework is equal to or very slightly greater than the minimum flow rate $Q_{Am}$ for as long as possible, and then diverges therefrom, if necessary, by the smallest possible amount.

The resulting efficiency is also increased, and in addition combustion takes place with reduced formation of nitrogen oxides.

The method of the invention is characterized in that a temperature $T_2$ is set for the mixture of gas and ground material, which temperature is lower than $T_1$, $T_2$ possibly depending on the moisture content of the material, and in that when the minimum gas flow rate does not suffice for reaching the set temperature $T_2$ with the temperature of the feed gas raised to the maximum of its range, then the flow rate $Q_2$ of the gas fraction sent to the pre-drying means is increased by the amount necessary for reaching the temperature $T_2$.

The invention also provides a system for grinding solid fuel material having a variable moisture content, and for drying said material, the system comprising grinding and drying apparatus, material feed means, pre-drying means disposed downstream from the feed means and feeding the apparatus with material, first injection means for injecting gas into the apparatus, second injection means for injecting gas into the pre-drying means, gas feed means, said gas being split into a first fraction feeding the first injection means and a second fraction feeding the second injection means, adjustment means for adjusting the temperature of the feed means over a given range, conveyor pipework fed by the mixture of gases from the pre-drying means and the gas with the ground material coming from the apparatus, adjustment means for adjusting the first injection means to adjust the flow rate $Q_1$ of the gas fraction passing through the apparatus in proportion to the quantity of material to be ground, measurement means for measuring the temperature T of the mixture of gases and ground material in the conveyor pipework, adjustment means for adjusting the temperature of the gas of the feed means as a function of the difference between a set temperature $T_1$ and the measured temperature T in such a manner as to cause T to move closer to $T_1$, adjustment means for adjusting the second injection means in such a manner that the total gas flow rate $Q_A$ through the conveyor pipework lies between a minimum flow rate $Q_{Am}$ and a maximum flow rate $Q_{AM}$, the system being characterized in that the adjustment means of the second injection means are controlled firstly by a signal depending on $Q_{Am}$ in such a manner that the total gas flow rate $Q_A$ is caused to be equal to $Q_{Am}$ so long as the gas outlet temperature T is greater than a temperature $T_2$ lower than $T_1$, with $T_2$ optionally being selected as a function of the moisture content of the material, and secondly, by a signal depending on the difference between the measured temperature T and the temperature $T_2$ when T is less than $T_2$ so as to increase the flow rate $Q_2$ of the gas fraction sent to the pre-drying means by the quantity required to cause the outlet temperature to reach $T_2$ without the total flow rate $Q_A$ exceeding the maximum flow rate $Q_{AM}$.

A method of adjusting the operation of a horizontal axis grinder of coal having a variable moisture content and a system for implementing the method are described below by way of example and with reference to the figures of the accompanying drawings, in which.

Figure 1:
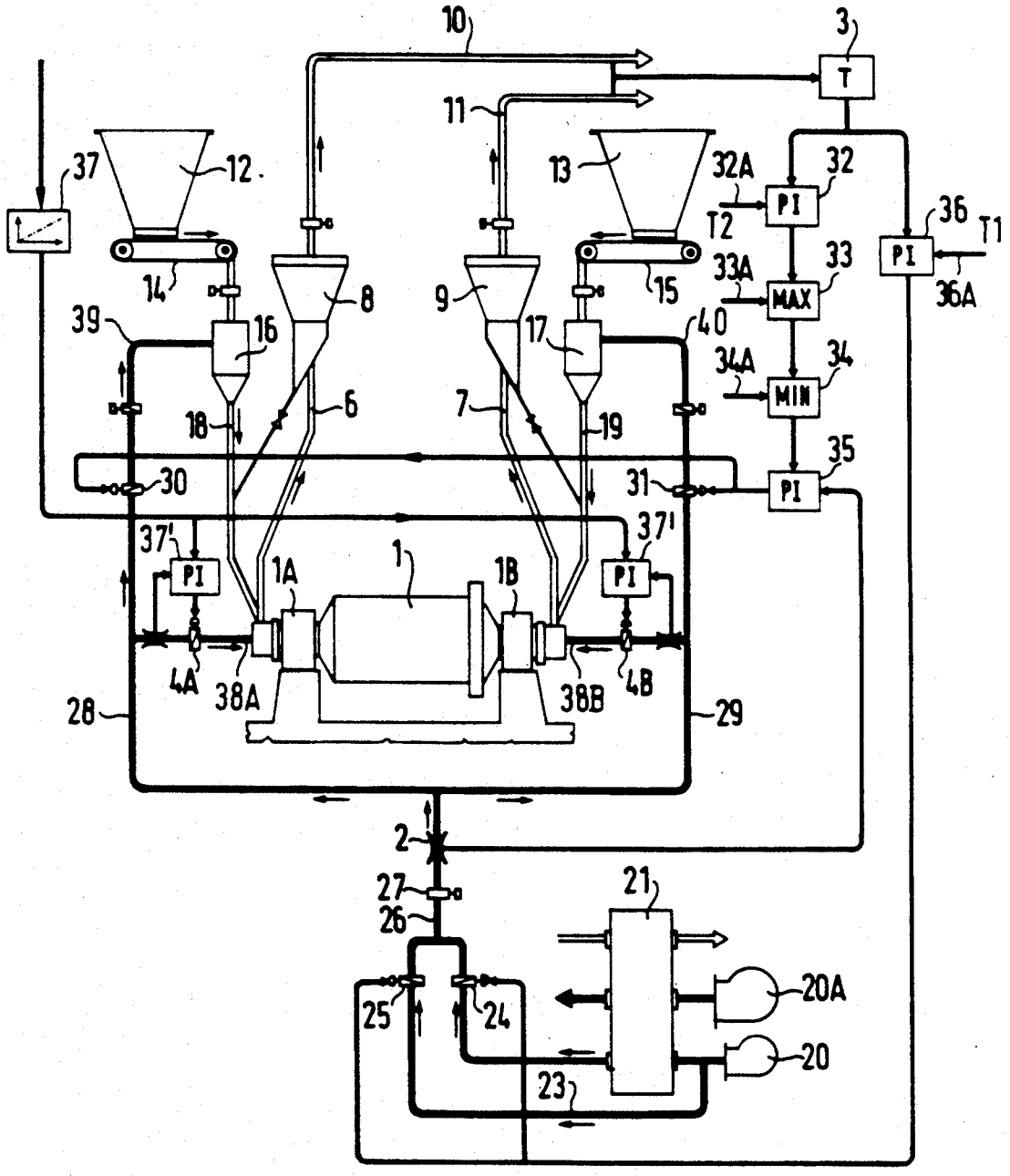
FIG. 1 is a diagram of the overall system.

In FIG. 1 a horizontal axis rotary ball grinder 1 rotates in bearings 1A and 1B, via which both coal and drying air are fed simultaneously. The total feed air flow rate is measured by a flow meter 2. The temperature T of the air carrying pulverized coal is measured at the outlet from the grinder in conveyor pipework 10 and 11 by means of a sensor 3. The flow rate $Q_1$ of air injected into the grinder via its bearings along ducts 38A and 38B is adjusted by valves 4A and 4B having proportional-integral control regulators 37'.

These regulators 37' are controlled by a member 37 for setting the charge requested for the boiler being fed with ground coal. In addition, a microprocessor 35 controlled by information from the sensor 3 in association with a minimum temperature setpoint 32 (for proportional-integral control), a maximum air flow rate setpoint 33, and a minimum air flow rate setpoint 34, uses valves 30 and 31 disposed on ducts 39 and 40 to adjust the flow rate $Q_2$ of that fraction of the air (bypass air) which is sent directly to the separators 8 and 9 via the mixing boxes 16–17. In these boxes 16 and 17, the air fraction at flow rate $Q_2$ serves to preheat and predry the material.

The feed air used for drying and conveying is delivered by fan 20. A portion is heated in a heat exchanger 21 which simultaneously heats a fraction of the secondary air delivered by fan 20A and sent directly to the burners in the hearth of the boiler. Another portion is not heated and bypasses the heat exchanger via duct 23. The respective hot and cold air flow rates are adjusted by valves 24 and 25 under the control of the microprocessor 36 providing proportional-integral control on the basis of a temperature setpoint 36A and controlled by the sensor 3 for sensing the temperature of air charged with pulverized coal at the outlet from the mixer. The hot and cold air flows are mixed together in the duct 26 which is provided with a closure valve 27. The duct 26 is split into two ducts 28 and 29, with the duct 28 further splitting into two ducts 38A and 39, and with the duct 29 further splitting into two ducts 38B and 40.

The coal to be ground is poured into hoppers 12 and 13 and is delivered by feeders 14 and 15 into the mixing boxes 16 and 17 in which it is mixed with the air fraction that is not injected into the grinder, i.e. the air fraction arriving via ducts 28 and 29. Thereafter the coal flows towards the grinder via pipework 18 and 19 and penetrates into the grinder via its bearings 1A and 1B coaxially with the fraction of the air which that is injected directly into the grinder via valves 4A and 4B under the control of the proportional-integral regulators 37' which in turn receive instructions from the member 37 for setting the charge demanded by the boiler, as mentioned above.

The air fraction that is charged with pulverized coal is removed from the grinder via the bearings 1A and 1B, and then after the bypass air fraction from the mixing boxes 16 and 17 is added thereto, it passes along ducts 6 and 7 towards separators 8 and 9. In the separators, the particles of coal are separated into large particles which are recycled via the grinder feed ducts 18 and 19, and fine particles which are delivered to the burners in the hearth of the boiler. As mentioned above, the temperature of this outlet air is measured by the sensor 3 and is transmitted to the microprocessor 36 for fixing the temperature setpoint and for controlling the respective flow rates of the hot and cold air fractions by means of the valves 24 and 25.

This temperature is also transmitted to computer 32 for generating a control signal as a function of the difference between the measured temperature and the setpoint provided at 32A.

Figure 2:
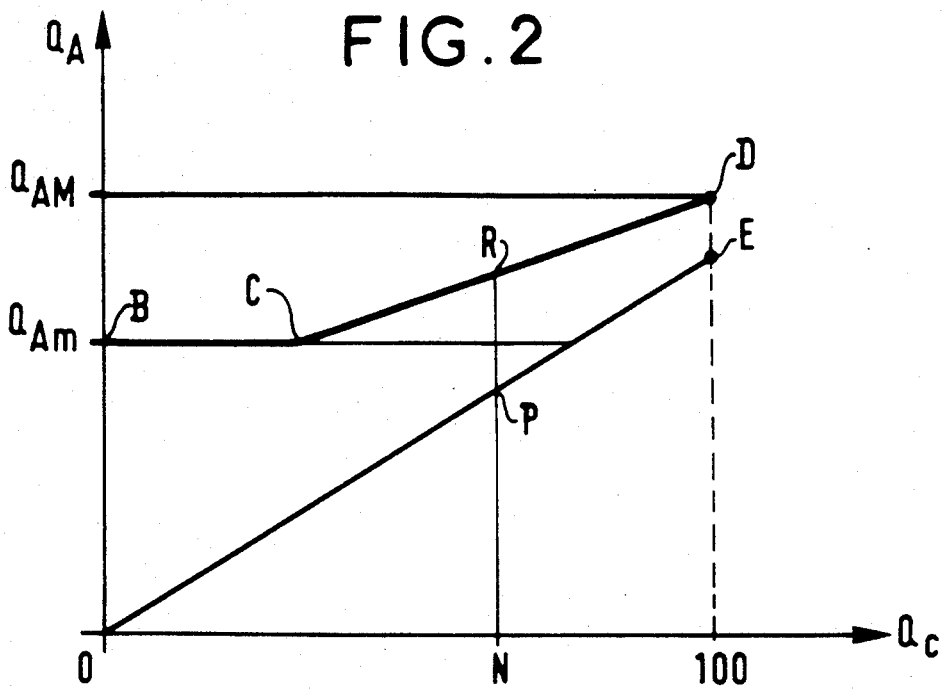
FIG. 2 shows how air flow rate is regulated as a function of coal flow rate in the prior art method and devices.

FIG. 2 shows how air flow rate $Q_A$ is regulated in conveyor ducting 10, 11 as a function of coal flow rate $Q_C$.

Air flow rate $Q_1$ (straight line segment OE, where E has an X-axis coordinate of 100) passing through the grinder is proportional to the coal flow rate. The flow rate $Q_A$ must be not less than a minimum flow rate $Q_{Am}$ and must be no greater than a maximum flow rate $Q_{AM}$. The total flow rate $Q_A$ (equal to $Q_1+Q_2$) as a function of $Q_c$ is a horizontal segment BC at Y-axis coordinate $Q_{Am}$, then a sloping segment CD with point D having Y-coordinate $Q_{AM}$ and X-coordinate 100 (corresponding to the maximum flow rate of ground coal).

For a ground coal flow rate $Q_c$ represented by ON on the Y-axis $OQ_c$, the flow rate $Q_1$ of air passing through the grinder will be equal to PN (P being the point on straight line OE having X coordinate ON), and the flow rate $Q_2$ of air passing through the pre-drying means 16 and 17 (or bypass air) will be equal to PR (where R is the point on segment CD having X coordinate ON).

Air flow rate $Q_1$ (PN) passing through the grinder is determined by the control system 37, 37' as a function of $Q_c$.

In the prior art system, control system 32, 33, and 34 does not exist. The computer 35 controls the valves 31 and 30 so that the quantity of bypass air $Q_2$ is equal to PR so that the angled line BCD is always followed.

This line is selected so that the temperature of the outlet air is equal to $T_1$ for coal having the highest moisture content that may be ground for the associated boiler by delivering the hottest possible feed air, i.e. with the valve 25 closed.

If a coal is less moist, the outlet temperature T will increase, and the computer 36 on which the setpoint temperature $T_1$ is applied at 36A will deliver a signal to open the cold air flow valve 24 and close the hot air valve 25 so as to reduce the temperature of the feed air so that the measured temperature of the outlet air is equal to $T_1$.

Figure 3:
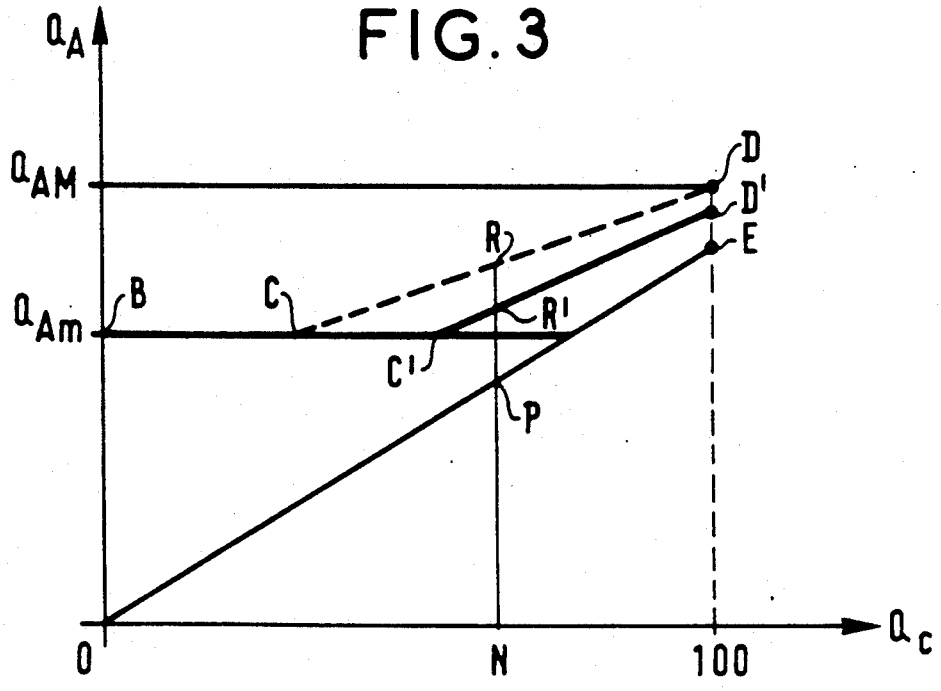
FIG. 3 shows how the air flow rate is regulated as a function of the coal flow rate in the method of the invention.

FIG. 3 shows the method of the invention. In this $Q_c$, $Q_A$ graph, angled line BCD corresponds to coal having the highest moisture content treatable for the boiler under consideration.

If the moisture content of the coal is less, then a decision is made to follow a different angled line BC'D'. The segment BC' is longer than the segment BC, and the slope of the segment C'D' is slightly steeper than segment CD, but for the quantity $Q_c$ corresponding to the maximum amount of treatable coal, a point D' is reached which is situated beneath D and above E.

The air flow rate passing through the grinder as a function of $Q_c$ continues to be represented by straight line segment OE. Thus, for a quantity ON of coal, the air flow rate $Q_1$ passing through the grinder is PN, however the quantity $Q_2$ of pre-drying air that needs to be added thereto is equal to PR' which is less than PR. When on the segment OE (above $Q_{Am}$), the quantity $Q_2$ is zero.

To be able to follow the line BC'D', a temperature $T_2$ is set lower than $T_1$ and is applied to input 32A of computer 32, which allows the minimum signal to pass. Thus, if T is less than $T_2$, then it is the signal corresponding to T which passes, with setpoints 33 and 34 ensuring that the command applied to the computer 35 does not give rise to a flow rate $Q_A$ that is less than the minimum flow rate $Q_{Am}$ or greater than the maximum flow rate $Q_{AM}$. The flow rate $Q_A$ increases until the temperature $T_2$ is reached, which corresponds to branch B'C'.

Given that $T_1$ is greater than $T_2$, the computer 36 will open the hot air valve 24 to the maximum and close the cold air valve 25. Feed air is thus obtained having the highest temperature of the adjustment range, and by virtue of the computer 35, a minimum quantity $Q_2$ (PR') of this hot air is sent through the pre-heating means.

By virtue of the method of the invention, the segment CD is replaced by angled line CC'D'.

It is thus possible to use the hottest possible feed air for obtaining a outlet air temperature $T_2$ and to limit the bypass air as much as possible. In the prior method, instead of limiting the bypass air flow rate $Q_2$ when the coal is less moist, the same quantity of bypass air is sent but at a lower temperature, thereby firstly reducing efficiency and secondly increasing the total air flow rate $Q_A$ and thus giving rise to combustion that produces nitrogen oxides.

The drier the coal, the longer the line BC' and the lower the point D' while still maintaining the same reference temperature $T_2$.

The invention thus relates firstly to adjusting the operation of apparatus for grinding fossil fuels such as coal, and also to grinding non-combustible materials such as minerals.

I claim:

1. A method of adjusting the operation of apparatus (1) for grinding a solid fuel material having a variable moisture content, and for drying said material, said apparatus (1) being fed with material via pre-drying means (16, 17) in which there is a gas feed (20, 24, 25) whose temperature can be adjusted over a range, the gas being split into two fractions, one fraction of the gas passing through the grinding apparatus (1) and the other fraction of the gas being sent to the pre-drying means (16, 17), the flow rate $Q_1$ of the fraction of the gas passing through the apparatus (1) being adjusted to be proportional to the quantity $Q_c$ of material to be ground, the fraction $Q_2$ of gas passing through the pre-drying means (16, 17) rejoining the fraction $Q_1$ of gas leaving the apparatus (1) together with the ground material, and all of the gas and ground material being sent via conveyor pipework (10, 11), the temperature T of the gas and the ground material in said conveyor pipework (10, 11) being measured, the temperature of the feed gas being adjusted as a function of the difference between a set temperature $T_1$ and the measured temperature T in such a manner as to cause the measured temperature T to move closer to $T_1$, the flow rate of the gas fraction feeding the pre-drying means (16, 17) being adjusted in such a manner that the total gas flow rate $Q_A$ in the conveyor ducting (10, 11) lies between a minimum flow rate $Q_{Am}$ and a maximum flow rate $Q_{AM}$, the method being characterized in that a temperature $T_2$ is set for the mixture of gas and ground material, which temperature is lower than $T_1$, $T_2$ depending on the moisture content of the material, and in that when the minimum gas flow rate $Q_{Am}$ does not suffice for reaching the set temperature $T_2$, with the temperature of the feed gas raised to the maximum of its range, then the flow rate $Q_2$ of the gas fraction sent to the pre-drying means (16, 17) is increased by the amount necessary for reaching the temperature $T_2$.

2. A system for grinding solid fuel material having a variable moisture content, and for drying said material, the system comprising grinding and drying apparatus (1), material feed means (12, 13), pre-drying means (16, 17) disposed downstream from the feed means (12, 13) and feeding the apparatus (1) with material, first injection means (38A, 38B) for injecting gas into the apparatus (1), second injection means (39, 40) for injecting gas into the pre-drying means (16, 17), gas feed means (20, 24, 25, 26), said gas being split into a first fraction feeding the first injection means (38A, 38B) and a second fraction feeding the second injection means (39, 40), adjustment means (36) for adjusting the temperature of the feed gas (20, 24, 25, 26) over a given range, conveyor pipework (10, 11) fed by the mixture of gases from the pre-drying means (16, 17) and the gas with the ground material coming from the apparatus (1), adjustment means (4A, 4B) for adjusting the first injection means (38A, 38B) to adjust the flow rate $Q_1$ of the gas fraction passing through the apparatus (1) in proportion to the quantity $Q_2$ of material to be ground, measurement means (3) for measuring the temperature T of the mixture of gases and ground material in the conveyor ducting (10, 11), adjustment means (24, 25, 36) for adjusting the temperature of the gas of the feed means (20, 21) as a function of the difference between a set temperature $T_1$ and the measured temperature T in such a manner as to cause T to move closer to $T_1$, adjustment means (30, 31, 35) for adjusting the second injection means (39, 40) in such a manner that the total gas flow rate $Q_A$ through the conveyor ducting (10, 11) lies between a minimum flow rate $Q_{Am}$ and a maximum flow rate $Q_{AM}$, the system being characterized in that the adjustment means (30, 31, 35) of the second injection means (39, 40) are controlled firstly by a signal depending on $Q_{Am}$ in such a manner that the total gas flow rate $Q_A$ is caused to be equal to $Q_{Am}$ so long as the gas outlet temperature T is greater than a temperature $T_2$ lower than $T_1$, with $T_2$ optionally being selected as a function of the moisture content of the material, and secondly, by a signal depending on the difference between the measured temperature T and the temperature $T_2$ when T is less than $T_2$ so as to increase the flow rate $Q_2$ of the gas fraction sent to the pre-drying means (16, 17) by the quantity required to cause the outlet temperature to reach $T_2$ without the total flow rate $Q_A$ exceeding the maximum flow rate $Q_{AM}$.

* * * * *